US005842562A

United States Patent [19]

Bauman

[11] Patent Number: 5,842,562

[45] Date of Patent: Dec. 1, 1998

[54] STUFFED ANIMAL JEWELRY HOLDER

[76] Inventor: Marianne Bauman, 626 Wyndemere Ave., Ridgewood, N.J. 07450

[21] Appl. No.: 960,349

[22] Filed: Oct. 29, 1997

[51] Int. Cl.[6] ..... A45C 11/04

[52] U.S. Cl. ..... 206/6.1; 206/566; 446/73

[58] Field of Search ..... 206/6.1, 457, 566; 446/73, 75, 372, 385

[56] References Cited

U.S. PATENT DOCUMENTS

| | | | |
|---|---|---|---|
| 4,590,633 | 5/1986 | Pickens | 5/482 |
| 4,767,011 | 8/1988 | Butler . | |
| 4,905,821 | 3/1990 | Corbett . | |
| 4,950,196 | 8/1990 | Fortune et al. | 446/73 |
| 5,217,192 | 6/1993 | Oktayuren | 248/102 |
| 5,318,469 | 6/1994 | Unalp et al. . | |
| 5,328,401 | 7/1994 | DeMars | 446/295 |
| 5,344,356 | 9/1994 | Pizzelli et al. . | |
| 5,433,643 | 7/1995 | Pratt . | |

*Primary Examiner*—Paul T. Sewell
*Assistant Examiner*—Nhan T. Lam
*Attorney, Agent, or Firm*—Robert L. Epstein; Harold James; James & Franklin

[57] ABSTRACT

The stuffed animal has a body covered by simulated fur material. First and second ears extend from the head in an upstanding manner. Each ear includes a mesh section adapted to receive the jewelry. The edges of the mesh section are covered by the simulated fur material. To increase the rigidity of the ears, each mesh section may be creased along its axis. The ears may be stitched together at a point spaced from the head. Reinforcing strips may be employed. The strips are enclosed by the simulated fur material along the edges of the ears.

22 Claims, 2 Drawing Sheets

FIG. 2
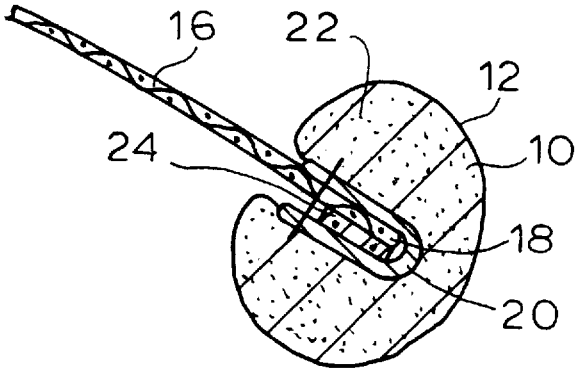
FIG. 3
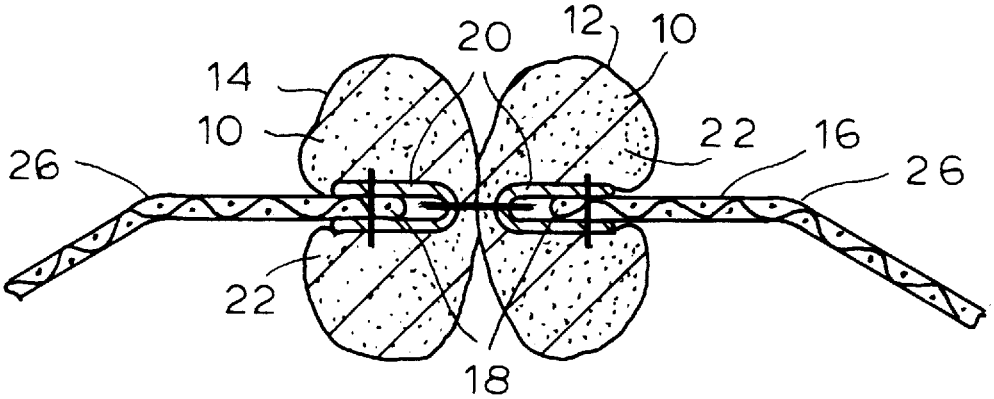
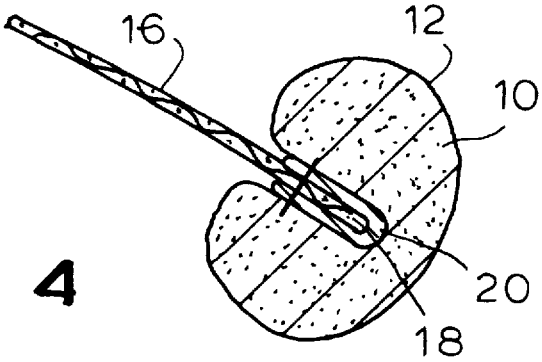
FIG. 4

STUFFED ANIMAL JEWELRY HOLDER

The present invention relates to holders for jewelry, such as earrings, decorative pins, metals or other ornamental objects which have a stem, hook, pin or similar elongated mounting part capable of being inserted through an opening in a mesh or screen, and more particularly to such a jewelry holder which takes the form of stuffed animal.

Holders for jewelry consisting of a section of mesh or woven material stretched over a rigid frame which has a stand or base are disclosed in U.S. Pat. No. 4,767,011 issued to Susan Butler on Aug. 30, 1998 and U.S. Pat. No. 4,905,821 issued to Mary D. Corbett on Mar. 6, 1990. However, the Butler and Corbett holders are not asthetically pleasing and may not be suitable for use by children or young adolescents.

U.S. Pat. No. 5,344,356 issued Sep. 6, 1994 to Pizzelli et al. teaches a toy, which may be in the configuration of a stuffed animal, with a VELCRO surface. Small items such as hair bows, combs and barrettes may be removeably affixed to the surface of the toy. However, that patent does not teach the use of a mesh section and the disclosed toy cannot be used to mount anything which would penetrate the VELCRO surface, such as an earring or a decorative pin.

The present invention is a jewelry holder which takes the form of a stuffed animal whose upstanding ears and formed in part of mesh. Jewelry items of various types can be affixed to the ears by inserting the mounting part of the item through the mesh. In this way, the jewelry item is not only retained in a safe manner but is displayed, as well.

It is therefore a prime object of the present invention to provide a jewelry holder in the form of a stuffed animal.

It is another object of the present invention to provide a jewelry holder in the form of a stuffed animal with ears including mesh sections.

It is another object of the present invention to provide a stuffed animal jewelry holder with mesh ears which are structured so as to remain in an upstanding position when a multiplicity of jewelry items are situated therein.

It is another object of the present invention to provide a stuffed animal jewelry holder with mesh ears which have enhanced rigidity so as to remain upstanding when jewelry items are situated thereon.

In accordance with one aspect of the present invention, a jewelry holder is provided in the form of a stuffed animal having a body covered by material. An appendage extends from the body. The appendage has a mesh section. The edge of the mesh section is covered, at a least in part, by the cover material.

A second appendage is provided as are means for connecting appendages. The connection stabilizes the appendages in the upstanding position.

The animal may be a rabbit. The appendages may simulate the ears of the rabbit.

A crease may be provided along the axis of the mesh section of the appendage. The crease increases the rigidity of the mesh.

The mesh is preferrably formed of metal wire. The cover material may be simulated fur or other fabric.

Means are provided for structurally reinforcing the edge of the mesh section. The fabric material encloses the reinforcing means. The reinforcing means may comprise a coated wire or a flexible strip.

The fabric material is affixed to the edge of the mesh section. The fabric material is folded to form a recess to receive the edge of the mesh section. The portions of the folded fabric material are sewn together with the edge of the mesh section therebetween. The reinforcing means is preferrably situated within the recess.

The appendage connecting means takes the form of means for stitching together a portion of the fabric material of each ear. The connecting means is preferrably spaced from the head.

In accordance with another aspect of the present invention, a jewelry holder is provided in the form of a stuffed animal having a body covered by simulated fur material, including a head, first and second simulated animal ears, each of the ears extending from the head in a substantially upstanding manner, comprising a mesh section surrounded, at least in part, by the simulated fur material and means for connecting the ears.

To these and to such other objects which may hereinafter appear, the present invention relates to a stuffed animal jewelry holder as set forth in the following specification, recited in the annexed claims and illustrated in the accompanying drawings, wherein like numerals refer to like parts and in which:

FIG. 2 is an enlarged cross-sectional view taken along line 2—2 of FIG. 1 illustrating a portion of the ear, showing its construction and a reinforcing strip.

FIG. 3 is an enlarged cross-section view taken along line 3—3 of FIG. 1, showing the manner in which the ears are connected; and FIG. 4 is a view similar to that of FIG. 2, but showing the ear without the reinforcing strip.

Figure 1:
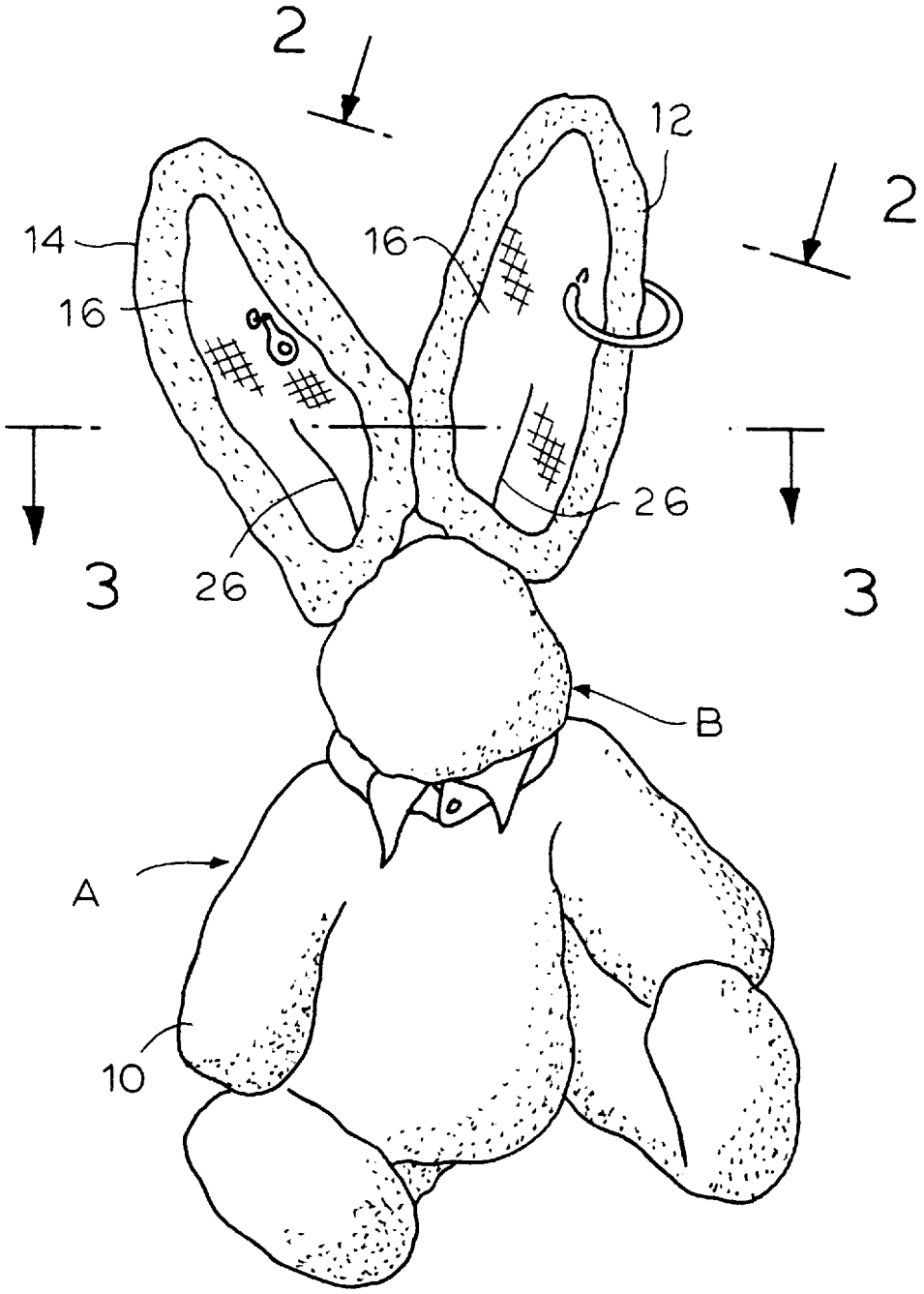
FIG. 1 is an isometric view of the jewelry holder of the present invention, in the preferred embodiment of a bunny rabbit.

The invention relates to a jewelry holder in the form of a stuffed animal or other character which has appendages, such as ears. It is adapted to retain and display earrings, decorative pins, broches, metals or any other item of jewelry which has a stem, hook, pin or similar elongated mounting part. The ears of the animal are formed in part of a mesh or screen-like material with openings sufficiently large to accept the mounting part of a jewelry item.

The invention is illustrated in the drawings in its preferred form as a bunny rabbit with relatively long, upstanding ears. However, it should be understood that the same inventive concept can be embodied in various forms, including stuffed animals of many different kinds, action figures and dolls. Clearly, the cover material which forms the hide or skin of the animal or figure is choosen to be appropriate to each situtation and need not be the simulated fur fabric, depicted here, which is suitable for the rabbit embodiment.

As seen in FIG. 1, the preferred embodiment of the invention takes the form of a stuffed bunny rabbit with a body, generally designated A, including a head, generally designated B, both of which are covered in a simulated fur material 10.

Situated on top of and extending from head B are a pair of appendages in the form of ears 12, 14. The ears may be sewn to material 10 or inserted into the stuffing in the head for additional structural support. Each ear 12, 14 includes an interior mesh section 16. The mesh section 16 has an edge 18. Section 16 is composed of metal or plastic screen material with openings sized appropriately for the mounting parts of the jewelry items to be retained.

As best seen in FIGS. 2 and 4, cover material 10 includes a base or support 20 upon which the simulated fur 22 is mounted. Material 10 is cut into a long strip and folded so as to create a recess into which the edge 18 of mesh section 16 is received.

The edges of material 10 are then stitched together so as to completely enclose the edge 18 of section 16 and form a border defining the ear. The simulated fur border should not be so thick, however, so as to create an obstacle to the mounting of hoop type earrings, as shown in FIG. 1.

A reinforcing or stiffing strip 24 may be included within the recess formed by material 10, as illustrated in FIG. 2. Strip 24 could be plastic or metal or any flexible material which tends to retain its shape. One or two strand small guage metal wire covered or coated with plastic material has been found to function well in this regard. Reinforcement or stiffening of the ear is particularly important if NYLON screen is used for the mesh, as same has little intrinsic rigidity.

Folding the mesh section to form a permanent crease 26 along the lower portion of the axis of each ear also increases the ability of the ear to stand upright. However, this works better with metal screen, which tends to retain the crease better than NYLON.

The ability of the ears to remain upright when weighted by many items is increased significantly by connecting the ears together at a point spaced from the surface of the head. FIG. 3 illustrates one simple way to accomplish such a connection. The base 20 of the material strips which border each ear are stitched together. This maintains a connection between the ears and prevents the ears from flopping in opposite directions.

It should now be apparent that the present invention relates to a jewelry holder in the form of a stuffed animal with mesh containing appendages adapted to retain and display earrings, decorative pins, broaches, metals and the like. The rigidity of the appendages may be increased by creasing the mesh, the use of reinforcing strips and/or connecting the appendages together.

While only a single preferred embodiment of the present invention is illustrated herein, it should be understood that there may be many variations and modifications could be made thereto. It is intended to cover all of these variations and modifications which fall within the scope of the present invention, as set forth by the following claims:

I claim:

1. A jewelry holder comprising a stuffed animal having a body covered by material, an appendage extending from the body and comprising a mesh section having an edge, said edge being covered, at least in part, by the cover material, a second appendage and means for connecting the appendages.

2. The holder of claim 1 wherein the appendage simulate the ear of the animal.

3. The holder of claim 1 wherein the animal is a rabbit.

4. The holder of claim 1 wherein the mesh is formed of metal wire.

5. The holder of claim 1 wherein the cover material is simulated fur.

6. The holder of claim 1 further comprising means for structurally reinforcing said appendage.

7. The holder of claim 1 wherein the cover material is situated around the edge of the mesh section.

8. The holder of claim 1 wherein the cover material is folded to form a recess to receive the edge of the mesh section.

9. The holder of claim 8 further comprising means for reinforcing the appendage, the reinforcing means being situated within the recess.

10. The holder of claim 1 wherein the connecting means comprises means for stitching the appendages together.

11. The holder of claim 1 wherein the connecting means is spaced from the body.

12. A jewelry holder comprising a stuffed animal having a body covered by material, an appendage extending from the body and comprising a mesh section having an edge, said edge being covered, at least in part, by the cover material and further comprising a crease in the mesh of said appendage.

13. The holder of claim 12 wherein said appendage has an axis and wherein said crease extends in the general direction of the axis.

14. A jewelry holder comprising a stuffed animal having a body covered by material, an appendage extending from the body and comprising a mesh section having an edge, said edge being covered, at least in part, by the cover material and means for structurally reinforcing said appendage, wherein the cover material encloses the reinforcing means.

15. The holder of claim 14 wherein the reinforcing means comprises a flexible strip.

16. The holder of claim 15 wherein the flexible strip comprises a coated wire.

17. A jewelry holder comprising a stuffed animal having a body including a head covered by simulated fur material, first and second simulated ears, each of the ears extending from the head and comprising a mesh section surrounded, at least in part, by the simulated fur material and means for connecting the ears together.

18. The holder of claim 17 wherein the animal is a rabbit.

19. The holder of claim 17 further comprising a crease in the mesh section of each ear.

20. The holder of claim 17 further comprising means for structurally reinforcing each ear.

21. The holder of claim 17 wherein the connecting means is spaced from the head.

22. A jewelry holder comprising a stuffed animal having a body covered by material, an appendage extending from the body and comprising a mesh section having an edge, said edge being covered, at least in part, by the cover material, wherein the cover material is folded to form a recess to receive the edge of the mesh section and wherein portions of the folded cover material are sewn together with the edge of the mesh therebetween.

* * * * *